US011267045B2

(12) United States Patent
Johansson et al.

(10) Patent No.: US 11,267,045 B2
(45) Date of Patent: Mar. 8, 2022

(54) ROLL LINE UNIT

(71) Applicant: AKTIEBOLAGET SKF, Gothenburg (SE)

(72) Inventors: Mats Johansson, Västra Frölunda (SE); Erik Mitchell, Hovås (SE)

(73) Assignee: AKTIEBOLAGET SKF, Gothenburg (SE)

( * ) Notice: Subject to any disclaimer, the term of this patent is extended or adjusted under 35 U.S.C. 154(b) by 0 days.

(21) Appl. No.: 17/082,287

(22) Filed: Oct. 28, 2020

(65) Prior Publication Data

US 2021/0187600 A1 Jun. 24, 2021

(30) Foreign Application Priority Data

Dec. 20, 2019 (DE) ..... 102019220318.3

(51) Int. Cl.
*B22D 11/128* (2006.01)

(52) U.S. Cl.
CPC ..... *B22D 11/1287* (2013.01)

(58) Field of Classification Search
CPC .. B22D 11/128; B22D 11/1287; B22D 11/142
USPC ..... 164/149, 442, 448
See application file for complete search history.

(56) References Cited

U.S. PATENT DOCUMENTS 3,981,348 A * 9/1976 Schmucker ..... B22D 11/1287 164/149
4,000,553 A * 1/1977 Spannlang et al. ..... B22D 11/1287 492/1

FOREIGN PATENT DOCUMENTS

EP 2300181 B1 7/2014
WO WO 2010/005354 A1 * 1/2010 ..... B22D 11/1287

* cited by examiner

*Primary Examiner* — Kevin P Kerns
(74) *Attorney, Agent, or Firm* — J-Tek Law PLLC; Scott T. Wakeman; Mark A. Ussai

(57) ABSTRACT

A roll line unit for a continuous casting apparatus includes a roll mantle or roll body surface rotatable relative to a support housing by means of bearing(s). The support housing has a seal(s) located axially outward relative to the at least one bearing and/or seal(s) located axially inward relative to the at least one bearing, and a lubrication system having lubricant reservoir(s) containing lubricant. The support housing has one or more cavities containing lubricant located adjacent to the seal disposed axially outward of the bearing(s) and/or the seal located axially inward of the bearing(s). The lubricant reservoir(s) is/are in fluid communication with the at least one cavity. An actuator within the lubricant reservoir(s) is arranged to move when the volume of lubricant increases in the cavity and/or the reservoir, and/or to push lubricant from the lubricant reservoir into the cavity when the amount of lubricant in the cavity decreases.

20 Claims, 3 Drawing Sheets

ROLL LINE UNIT

CROSS-REFERENCE

This application claims priority to German Patent Application No. DE 10 2019 220 318.3, filed Dec. 20, 2019, the entire contents of which are fully incorporated herein by reference.

BACKGROUND OF THE INVENTION

The present invention concerns a roll line unit that is suitable for a roll line of a continuous casting apparatus.

In a continuous casting process molten metal flows from a ladle, through a tundish into a mold having water-cooled walls. Once in the mold, the molten metal solidifies against the water-cooled mold walls to form a solid shell. This shell containing the liquid metal, now called a strand, is withdrawn continuously from the bottom of the mold. The strand is supported by closely spaced, water-cooled roll lines which act to support the walls of the strand against the ferrostatic pressure of the still-solidifying liquid within the strand. To increase the rate of solidification, the strand is sprayed with large amounts of water. Finally, the strand is cut into predetermined lengths. The strand may then continue through additional roll lines and other mechanisms which flatten, roll or extrude the metal product into its final shape.

Since cast metal strands leave the mold at a temperature above 900° C., in particular in the case of steel strands, the roll mantles or roll bodies of the roll lines are usually provided with internal cooling to facilitate cooling of the strands passing over them and to extend the useful service life of the roll mantles or roll bodies.

Apart from high temperatures, the roll lines used in continuous casting plants are also subjected to extreme wear due to the high loads, large temperature variations, high humidity, high corrosion, abrasion, and high contamination during use. These harsh operating conditions can make adequate lubrication of components, such as bearings, difficult and limit a roll line's useful service life and productivity. Their service life is namely relatively short compared with other components used in a continuous casting plant. For this mason, the roll lines must be exchanged for new roll lines or overhauled roll lines frequently. If the roll lines fail, they have to be substituted within the shortest possible time so that down time of the continuous casting plant is minimized. The roll lines are relatively large and heavy, and exchanging them is difficult and time consuming.

A lubricant, such as grease, protects the mechanisms that it lubricates against corrosion and wear, it helps to dissipate heat, seal out solid and liquid contamination, and reduces noise. Adequate lubrication allows for smooth continuous operation of equipment, with only mild wear, and without excessive stresses or seizures at components, such as bearings. When lubrication fails, components can rub destructively over each other, causing damage, heat, and failure. Lubrication failure can be caused by insufficient lubricant quantity or viscosity, deterioration due to prolonged service without replenishment, excessive temperatures, contamination with foreign matter, or the use of the incorrect lubricant for a particular application and/or over-lubricating.

To ensure that a mechanism is correctly lubricated, the lubricant used has to be precisely selected for the particular application and applied in the right amount, at the right frequency and to the right place(s) in the mechanism. Factors influencing the choice of lubricant for a bearing application for example, include the bearing's rotational speed, service temperature range, running noise requirements, re-lubrication intervals, sealing, starting torque, load and running conditions and environmental influences.

Over time, the lubricant may leak, evaporate and/or harden. Oil may be depleted from a lubricant such as grease leaving a thick waxy substance with little or no ability to lubricate.

"Fully sealed" or "lubricated for life" roll line units, such as SKF's CONRO™ roll line units, which comprise a roll mantle or roll body surface that is rotatable relative to a sealed support housing are known. The sealed support housing protects the bearings that rotatably connect the roll mantle or roll body surface to the support housing from the ingress of water and contaminants and contains a lubrication solution. The lubrication solution contains lubricant of sufficient quality and in a sufficient amount at the proper location(s) to survive the entire service life of roll line unit. The lubrication solution is therefore re-lubrication-free. There is however usually only limited space for a lubrication solution within a roll line unit.

SUMMARY OF THE INVENTION

An object of the invention is to provide an improved roll line unit that is suitable for a roll line of a continuous casting apparatus.

This object is achieved by a roll line unit comprising a roll mantle or roll body surface that is rotatable relative to a support housing, and at least one bearing rotatably connecting the roll mantle or roll body surface to the support housing. The support housing contains at least one seal located axially outward relative to the at least one bearing and/or at least one seal located axially inward relative to the at least one bearing, and a lubrication system comprising at least one lubricant reservoir containing lubricant. The support housing comprises at least one cavity containing an amount of lubricant, which is located adjacent to the at least one seal located axially outward relative to the at least one bearing and/or at least one seal located axially inward relative to the at least one bearing. The at least one lubricant reservoir is in fluid communication with the at least one cavity. The at least one lubricant reservoir comprises an actuator that is arranged to move when the volume of lubricant in the at least one cavity and/or the at least one lubricant reservoir increases. Additionally, or alternatively, the actuator is arranged to move so as to push lubricant from the at least one lubricant reservoir into the at least one cavity when the amount of lubricant in the at least one cavity decreases.

The roll line unit according to the present invention provides a robust, self-contained roll line unit, whose bearings are protected since the at least one cavity containing lubricant provides an extra barrier that prevents or hinders the ingress of water and contaminants into the roll line unit's support housing. The bearings that are located at the center regions of a roll line, which are subjected to the highest mechanical stresses during the use of the roll line unit, can consequently be more protected than bearings in conventional roll line units and can thereby achieve a longer service life.

Additionally, any lubricant that is lost from the roll line unit, via leakage past a seal for example, will be replaced by lubricant from the lubricant reservoir, thereby prolonging the service life of the components that the lubricant lubricated.

Furthermore, since the actuator accommodates fluctuations in the volume of lubricant in the lubrication system when lubricant is heated and expands or when excess lubricant is returned to the lubrication system, pressure fluctuations inside the lubrication system will be minimized, which will result in less lubricant leaking out of the system when the pressure inside the lubrication system increases. This results in a cleaner and more environmentally friendly working environment and a longer service life since there is less lubricant loss, less lubricant contamination, and less leakage of lubricant into a water treatment system, for example.

Using a roll line unit according to the present invention can increase operational reliability, reduce roll line operating costs, increase roll line unit service life, boost the reliability of a casting line, reduce unplanned downtime, eliminate lubrication system-maintenance, reduce lubricant consumption, and reduce costs due to decreased downtime for repairs and maintenance and reduced lubricant consumption.

The word "lubricant" as used herein is intended to means any non-gaseous substance that is capable of reducing friction and/or heat and/or wear when introduced as a film between solid surfaces. It refers to all liquid and semi-solid lubricants, such as oil- and grease-based fluids, which are suitable for use in a roll line unit.

The expression "a roll mantle or roll body surface that is rotatable relative to a support housing" as used herein is intended to mean the surface of a roll mantle or roll body that is arranged to be in supportive contact with the objects being transported along a roll line. For example, it refers to the surface of a roll mantle or roll body that is arranged to come into contact with cast metal strands during a continuous casting process. The expression "length of the roll mantle or roll body" is intended to mean the length of the surface that is rotatable relative to a support housing as measured from one end region of the roller mantle to the other end region of the roller mantle.

The expression "a shaft" is intended to mean at least one rotating or non-rotating bar that is used to support one or more roll mantles, or an integral part of a roll body. The cross-section of a shaft usually, but not necessarily, circular. The expression "a shaft" is intended to mean either a single shaft that passes through the entire length of a roll mantle, or a plurality of shafts which support only the ends of a roller mantle but do pass through the entire length of the roll mantle. A roll line can comprise a plurality of roll line units mounted on a common shaft.

The term "seal located axially outward relative to the at least one bearing" is intended to mean that the seal extends to a point that is closer to the outermost end of the support housing in a direction along or parallel to axis about which the roll mantle or roll body surface rotates.

The term "seal located axially inward relative to the at least one bearing" is intended to mean that the seal extends to a point that is closer to the center of the roll mantle or roll body in a direction along or parallel to axis about which the roll mantle or roll body surface rotates.

According to an embodiment of the invention the actuator comprises at least one of the following: a spring, a membrane, a spring-loaded device, such as a spring-loaded piston 43, a mechanical or electrical control means.

According to an embodiment of the invention the lubricant in the at least one cavity is arranged to lubricate the at least one bearing and/or any other component(s) of the roll line unit, such as one or more seals, i.e. the one or more seals located axially outward and/or inward relative to the at least one bearing, and/or any other seal of the roll line unit. Alternatively, the at least one bearing is a sealed bearing, whereby the lubricant in the at least one cavity does not lubricate the at least one bearing, but is instead used to lubricate the other components of the roll unit, such as for example the seals.

According to an embodiment of the invention the at least one cavity has a volume in which lubricant is contained and at least 70%, or at least 80%, or at least 90% or 100% of the volume is filled with lubricant, i.e. the at least one cavity may be partly or fully filled with lubricant.

According to an embodiment of the invention the support housing comprises at least one support post, i.e. at least one part that is in contact with the surface on which the roll line unit is placed or mounted, such as a floor or wall or frame, and the at least one lubricant reservoir is located inside the at least one support post. Alternatively and/or additionally, at least one lubricant reservoir may be located remotely from the support housing, such as on or inside a sub-frame or any other structure, such as a beam or platform on which the roll line unit is placed or mounted.

According to an embodiment of the invention the lubrication system is a re-lubrication-free lubrication system, whereby the lubrication system contains lubricant of sufficient quality and in a sufficient amount to survive the entire service life of roll line unit, i.e. whereby the lubrication system only has to be provided with lubricant once and does not need to be topped up or re-filled with lubricant during the service life of the roll line unit.

Alternatively, the at least one lubricant reservoir is arranged or configured to be filled from outside the support housing for example via an opening, such as a fluid inlet, in the support housing. More lubricant and/or one or more additives and/or components of the lubricant, such as a thickener, a tackifier, an anti-wear additive, an anti-corrosion additive, an extreme pressure (EP) additive and/or an anti-oxidant, can thereby be added to the lubricant in the lubrication system in order to increase the amount of lubricant in the lubrication system and/or to improve the quality of the lubricant in the lubrication system.

According to an embodiment of the invention the lubricant in the at least one cavity is arranged to apply a pressure to one or more seals inside the support housing, such as to at least one of the following: a bearing seal, a radial shaft seal, a mechanical seal, an axial clamp seal, an O-ring or a washer, a wear sleeve or V-ring seal, or an outer seal that seals the inside of the support housing off from its surroundings, i.e., the exterior environment, to improve the sealing effect of each such seal.

According to an embodiment of the invention, the roll line unit comprises at least one sensor to determine the amount and/or quality and/or temperature and/or contamination level of the lubricant in one or more parts of the lubrication system.

Signals from one or more sensors may be used to control the actuator and/or to inform an operator of the amount, quality and/or temperature of the lubricant in the lubrication system of a roll line unit.

The present invention also concerns a roll line for a continuous casting apparatus, which comprises at least one roll line unit according to any of the embodiments of the invention.

The present invention further concerns a continuous casting apparatus that comprises at least one roll line unit and/or at least one roll line according to any of the embodiments of the invention.

BRIEF DESCRIPTION OF THE DRAWINGS

The present invention will hereinafter be further explained by means of non-limiting examples with reference to the appended schematic figures. It should be noted that the drawings have not been drawn to scale and that the dimensions of certain features have been exaggerated for the sake of clarity. In the figures.

DETAILED DESCRIPTION OF EMBODIMENTS

Figure 1:
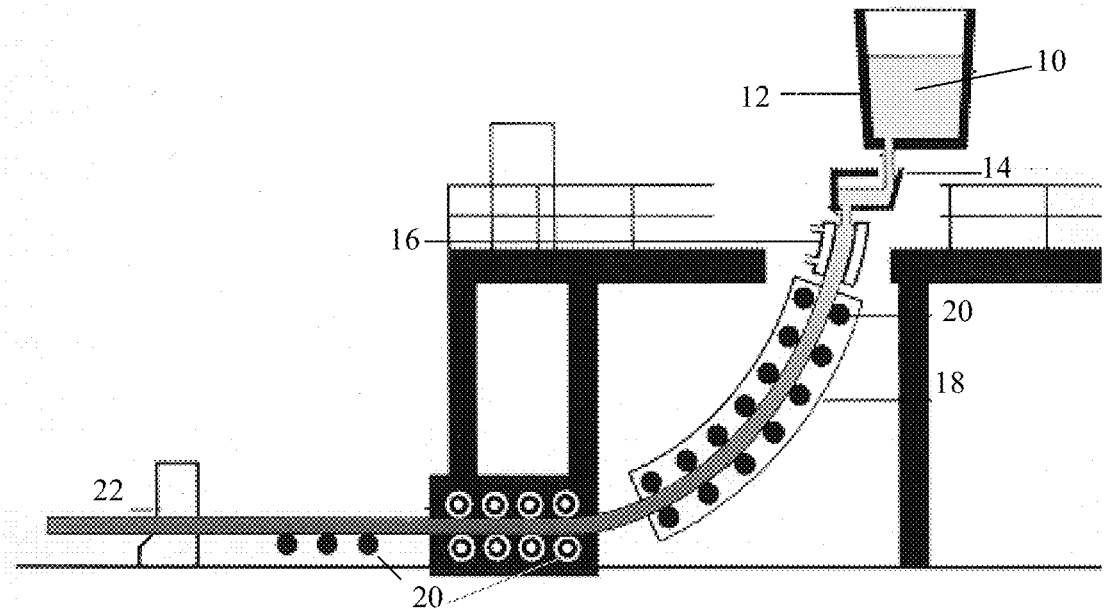
FIG. 1 shows a continuous casting apparatus.

FIG. 1 shows a continuous casting apparatus in which molten metal 10 is tapped into a ladle 12. After undergoing any ladle treatments, such as alloying and degassing, and arriving at the correct temperature, molten metal 10 from the ladle 12 is transferred via a refractory shroud to a tundish 14. Metal is drained from the tundish 14 into the top of an open-base mold 16. The mold 16 is water-cooled to solidify the molten metal directly in contact with it. In the mold 16, a thin shell of metal next to the mold walls solidifies before the middle section, now called a strand, exits the base of the mold 16 into a cooling chamber 18; the bulk of metal within the walls of the strand is still molten. The strand is supported by closely spaced, water-cooled roll lines 20 which act to support the walls of the strand against the ferrostatic pressure of the still-solidifying liquid within the strand. To increase the rate of solidification, the strand is sprayed with large amounts of water as it passes through the cooling chamber 18. Final solidification of the strand may take place after the strand has exited the cooling chamber 18.

In the illustrated embodiment the strand exits the mold 16 vertically (or on a near vertical curved path) and as it travels through the cooling chamber 18, the roll lines 20 gradually curve the strand towards the horizontal. (In a vertical casting machine, the strand stays vertical as it passes through the cooling chamber 18).

After exiting the cooling chamber 18, the strand passes through straightening roll lines (if cast on other than a vertical machine) and withdrawal roll lines. Finally, the strand is cut into predetermined lengths by mechanical shears or by travelling oxyacetylene torches 22 and either taken to a stockpile or the next forming process. In many cases the strand may continue though additional roll lines and other mechanisms which might flatten, roll or extrude the metal into its final shape.

Figure 2:
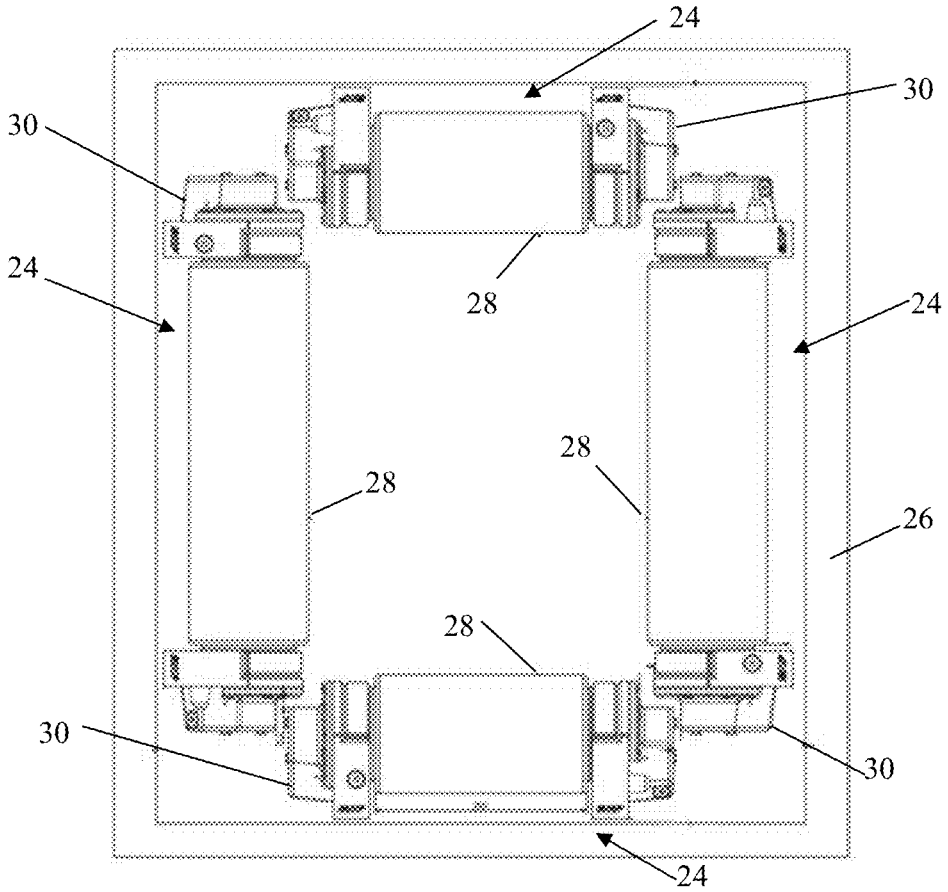
FIG. 2 shows a bloom caster comprising four roll line units according to an embodiment of the invention.

FIG. 2 shows a bloom caster comprising four roll line units 24 according to an embodiment of the invention of two different lengths which are mounted end to end in on a frame 26 in a rectangular formation. It should be noted that a roll line 20 can contain any number of roll line units 24 arranged in any suitable manner, such as end to end or side by side in a straight line.

Each roll line unit 24 comprises an exposed roll mantle surface or a roll body surface 28 that is rotatable relative to a support housing 30. The roll mantle surface or roll body surface 28 is arranged to come into contact with steel blooms, for example, which are transported through the frame 26 in a direction at a right angle into or out of the plane depicted in FIG. 2. It should be noted that a plurality of roll line units 24 according to the present invention may be arranged in any suitable manner or configuration in a continuous casting apparatus to facilitate the transport of a strand, billet, bloom or slab of steel. A plurality of roll line units 24 may for example be placed in a single line, optionally mounted on a common shaft, or on a polygonal frame 26 of any suitable size or shape.

Figure 3:
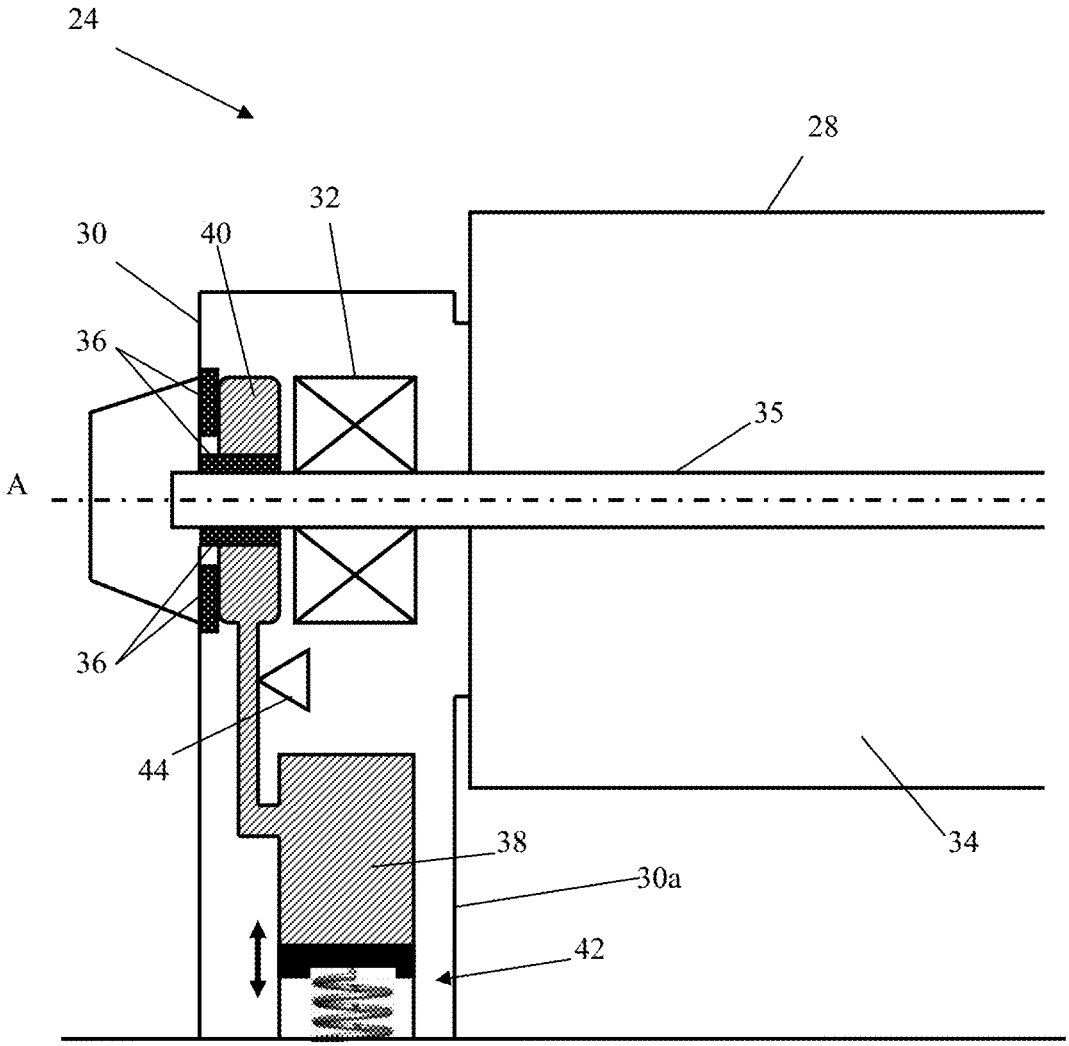
FIG. 3 shows a cross section of one end of a roll line unit according to an embodiment of the invention.
Figure 4:
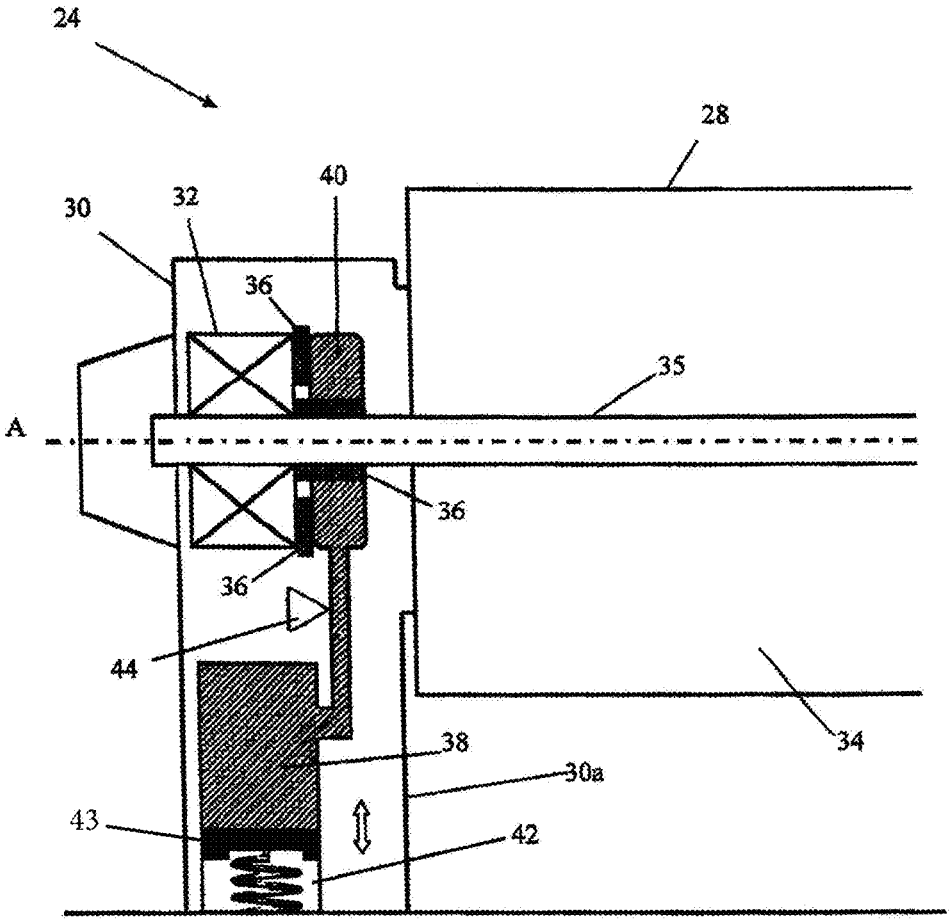
FIG. 4 shows a cross section of one end of a roll line unit according to another embodiment of the invention.

FIGS. 3 and 4 each depict one end of a roll line unit 24 according to an embodiment of the invention. The roll line unit 24 comprises at least one bearing 32 that rotatably connects a roll mantle or roll body surface 28 to the support housing 30.

It should be noted that a roll line unit 24 according to the present invention may comprise a roll mantle that is mounted on a rotatable shaft in a rotationally fixed manner, each roll mantle having an inner diameter corresponding to an outer diameter of the rotatable shaft. Alternatively, a roll mantle may be arranged to be mounted on a non-rotatable fixed shaft by means of bearings, whereby the roll mantle is arranged to be rotatable with respect to the fixed shaft. In another embodiment of the invention the roll line unit 24 according to the present invention may comprise a roll body comprising an integrated shaft.

In the illustrated embodiments, the roll line unit 24 comprises a roll mantle 34 fixedly mounted on a rotatable shaft 35 which is rotatable about axis A. The length of a roll mantle 34 or roll body may be 100-1200 millimeters (mm). A roll mantle 34 or roll body is not necessarily cylindrical and does not necessarily have a continuous or a smooth outer surface. It can have any uniform or non-uniform, symmetric or non-symmetric shape, size and/or cross section. The rotatable surface 28 of the roll mantle 34 or roll body may be continuous or non-continuous. The rotatable surface 28 may be even or uneven, and either comprise, or be free from, perceptible projections or indentations.

The support housing 30 may contain one or more seals 36 located axially outward relative to the at least one bearing 32, as depicted in FIG. 3, and a lubrication system comprising at least one lubricant reservoir 38 containing lubricant. The seals 36 may for example be provided between the shaft 35 and the roll mantle 34 or roll body. The support housing 30 may also contain one or more seals 36 located axially inward relative to the at least one bearing 32, as shown in FIG. 4.

The support housing 30 comprises at least one cavity 40 containing an amount of lubricant, which is located adjacent to the at least one seal 36. The at least one lubricant reservoir 38 is in fluid communication with the at least one cavity 40.

The end regions of the roll mantle 34 or roll body are subjected to high loads, high temperatures and high temperature variations, and usually to high humidity, high corrosion and high contamination. By locating a cavity 40 containing lubricant adjacent to a seal 36, an extra barrier against humidity, corrosion and contamination is provided.

The lubrication system further includes at least one actuator 42 disposed within or adjacent to the at least one lubricant reservoir 38, which is formed as a spring-loaded piston head 43 in the illustrated embodiment, configured or arranged to move in a first, preferably "downwards" direction when the volume of lubricant in the at least one cavity 40 and/or the at least one lubricant reservoir 38 increases during the use of the roll line unit 24. The actuator 42 is also configured or arranged to move in a second, opposing, preferably "upwards" direction so as to push or displace lubricant from the at least one lubricant reservoir 38 into the at least one cavity 40 when the amount of lubricant in the at least one cavity 40 decreases.

A partially compressed spring may for example be placed in contact with a moveable component, such as a piston head 43 (as indicated in FIG. 4) or a part of the lubricant reservoir 38, and the lubricant reservoir 38 may be filled with lubricant on preparing the roll line unit 24 for operation. The actuator spring will then be ready to expand or be compressed further when the roll line unit 24 is in use.

Alternatively, each actuator 42 may comprise a membrane that is arranged to absorb energy when the volume of lubricant in the at least one cavity 40 and/or the at least one lubricant reservoir 38 increases during the use of the roll line unit 24 and to release energy so as to push lubricant from the at least one lubricant reservoir 38 into the at least one cavity 40 when the amount of lubricant in the at least one cavity 40 decreases. The actuator 42 may include any suitable mechanical, electrical, gas pressure or hydraulic control means.

The at least one actuator 42 and amount of lubricant in the lubrication system should be selected so that the actuator 42 can accommodate all of the movement expected during the service life of the roll line unit 24.

The lubricant in the at least one cavity 40 may be arranged to lubricate the at least one bearing 32. Alternatively, the at least one bearing 32 is a sealed bearing, in which case the lubricant in the at least one cavity 40 is not used to lubricate the sealed bearing 32 but instead is arranged to lubricate other components of the roll line unit 24 (e.g., seals 36). A roll line unit 24 according to the present invention may however comprise or include both sealed and non-sealed bearings 32.

In the illustrated embodiment, the at least one cavity 40 has a volume in which lubricant is contained and may be arranged to be completely full of lubricant during the service life of the roll line unit 24. However, the volume of the at least one cavity 40 may be filled with lubricant up to an amount of at least 70%, or at least 80%, or at least 90%.

According to an embodiment of the invention, the actuator 42 may be arranged or configured to only move when the volume of lubricant in the at least one cavity 40 and/or the at least one lubricant reservoir 38 increases, or only to move so as to push lubricant from the at least one lubricant reservoir 38 into the at least one cavity 40 when the amount of lubricant in the at least one cavity 40 decreases. For example, in embodiments in which the at least one cavity 40 is not entirely full of lubricant, it may not be necessary for the actuator 42 to move when lubricant in the at least one cavity 40 and/or the at least one lubricant reservoir 38 is heated and expands or when excess lubricant is returned to the lubrication system since lubricant may be capable of expanding or flowing into the free space in the at least one cavity 40.

The support housing 30 may comprise one or more support posts 30*a* and at least one lubricant reservoir 38 may be located inside the one or more support posts 30*a*.

The lubrication system inside a roll line unit 24 according to the present invention may be a "re-lubrication-free" lubrication system; that is, a lubrication system which contains all of the lubricant needed for the entire service life or use of the roll unit 24 and does not need to be replenished. Alternatively, the roll line unit 24 may comprise at least one lubricant reservoir 38 that is arranged to be filled from outside the support housing 30. A roll line unit 24 according to the present invention may however comprise both re-lubrication-free and non-re-lubrication-free lubrication systems.

At least one lubricant reservoir 38 may be filled with a semi-solid lubricant, such as grease, which consists of a thickener, emulsified with mineral or vegetable oil and/or another fluid lubricant. Grease possesses a high initial viscosity, which upon the application of shear, drops to give the effect of oil lubrication of approximately the same viscosity as the base oil (or fluid lubricant) used in the grease. Greases are usually applied to mechanisms that can only be lubricated infrequently and where a lubricating oil would not stay in position.

The lubricant in the at least one cavity 40 is arranged to apply a pressure to one or more seals 36 inside the support housing 30, such as to at least one of the following: a seal, a bearing seal, a radial shaft seal, a mechanical seal, an axial clamp seal, an O-ring or a washer, a wear sleeve or V-ring seal. Alternatively, the lubricant in the at least one cavity 40 may be arranged or configured to apply pressure to an outer seal 36 that seals the inside of the support housing 30 off from its surroundings, i.e. the ambient air or the exterior environment. Further, the lubricant in the at least one cavity 40 may instead be arranged to apply a pressure to any other component(s) inside the roll line unit 24.

According to an embodiment of the invention a roll line unit 24 may comprise at least one sensor 44 configured to determine the amount of lubricant and/or the quality of the lubricant and/or the temperature of the lubricant and/or a contamination level of lubricant in one or more parts of the lubrication system.

FIGS. 3 and 4 each shows just one end of a roll line unit 24 according to the present invention. One or both of the ends of a roll line unit 24 may comprise the components shown in FIG. 3 and/or in FIG. 4. Furthermore, it should be noted that the at least one lubricant reservoir 38 need not necessarily be located in the center of a support housing 30, but each reservoir 38 may be located at any position inside the support housing 30, such as closer to one side of a support housing 30. For example, a lubricant reservoir 38 may be arranged to be in fluid communication with at least one cavity 40 located axially outward relative to at least one bearing 32, as shown in FIG. 3, or with at least one cavity 40 located axially inward relative to at least one bearing. 32 as depicted in FIG. 4, or with a plurality of cavities located both axially outward and axially inward relative to at the least one bearing 32. A single cavity 40 may be arranged to be in fluid communication with a plurality of lubricant reservoirs 38.

Representative, non-limiting examples of the present invention were described above in detail with reference to the attached drawings. This detailed description is merely intended to teach a person of skill in the art further details for practicing preferred aspects of the present teachings and is not intended to limit the scope of the invention.

Moreover, combinations of features and steps disclosed in the above detailed description may not be necessary to practice the invention in the broadest sense and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter. The invention is not restricted to the above-described embodiments, and may be varied within the scope of the following claims.

We claim:

1. A roll line unit for a continuous casting apparatus comprising:

a support housing;

a roll mantle or roll body surface rotatable relative to the support housing;

at least one bearing rotatably connecting the roll mantle or roll body surface to the support housing;

at least one seal located axially outward relative to the at least one bearing and/or at least one seal located axially inward relative to the at least one bearing; and a lubrication system including at least one lubricant reservoir containing lubricant;

wherein the support housing has at least one cavity containing an amount of lubricant, the at least one cavity being located adjacent to the at least one seal located axially outward relative to the at least one bearing and/or located adjacent to the at least one seal located axially inward relative to the at least one bearing, the at least one lubricant reservoir being in fluid communication with the at least one cavity; and wherein the lubrication system includes at least one actuator disposed within or adjacent to the at least one lubricant reservoir and configured to move when thea volume of lubricant increases within the at least one cavity and/or within the at least one lubricant reservoir and/or to move so as to push lubricant from the at least one lubricant reservoir into the at least one cavity when the amount of lubricant decreases within the at least one cavity.

2. The roll line unit according to claim 1, wherein the at least one actuator includes at least one of a spring, a membrane, a spring-loaded device, a mechanical, electrical, gas pressure or hydraulic control means.

3. The roll line unit according to claim 1, wherein the at least one actuator includes a spring-loaded piston.

4. The roll line unit according to claim 1, wherein the lubricant in the at least one cavity is arranged to lubricate at least one of the at least one bearing and the at least one seal.

5. The roll line unit according to claim 1, wherein the at least one bearing is a sealed bearing.

6. The roll line unit according to claim 1, wherein the at least one cavity has a volume in which lubricant is contained, at least seventy percent of the volume being filled with lubricant.

7. The roll line unit according to claim 1, wherein the support housing includes at least one support post and the at least one lubricant reservoir is located inside the at least one support post.

8. The roll line unit according to claim 1, wherein the lubrication system is a re-lubrication-free lubrication system.

9. The roll line unit according to claim 1, wherein the at least one lubricant reservoir is arranged to be filled from outside the support housing.

10. The roll line unit according to claim 1, wherein the lubricant in the at least one cavity is arranged to apply a pressure to at least one seal inside the support housing or to an outer seal configured to seal an inside of the support housing from an exterior environment.

11. The roll line unit according to claim 10, wherein the at least one seal inside the support housing is at least one of a bearing seal, a radial shaft seal, a mechanical seal, an axial clamp seal, an O-ring, a washer, a wear sleeve and a V-ring seal.

12. The roll line unit according to claim 1, further comprising at least one sensor configured to determine at least one of an amount of lubricant, a quality of lubricant, a temperature of lubricant and a contamination level of lubricant in one or more parts of the lubrication system.

13. The roll line unit according to claim 1, wherein the at least one bearing is disposed within the support housing and the at least one seal is located within the support housing.

14. A roll line unit for a continuous casting apparatus comprising:

a support housing;

a roll mantle or roll body surface rotatable relative to the support housing;

at least one bearing rotatably connecting the roll mantle or roll body surface to the support housing;

at least one seal located axially outward relative to the at least one bearing or located axially inward relative to the at least one bearing; and a lubrication system including at least one lubricant reservoir containing lubricant;

wherein the support housing has at least one cavity containing an amount of lubricant, the at least one cavity being located adjacent to the at least one seal located axially outward relative to the at least one bearing or located adjacent to the at least one seal located axially inward relative to the at least one bearing, the at least one lubricant reservoir being in fluid communication with the at least one cavity; and wherein the lubrication system includes at least one actuator disposed within or adjacent to the at least one lubricant reservoir and configured to move in a first direction when a volume of lubricant increases within the at least one cavity and/or within the at least one lubricant reservoir and/or to move in a second, opposing direction so as to displace lubricant from the at least one lubricant reservoir into the at least one cavity when the amount of lubricant decreases within the at least one cavity.

15. The roll line unit according to claim 14, wherein the at least one actuator includes a spring-loaded piston.

16. The roll line unit according to claim 14, wherein the lubricant in the at least one cavity is arranged to lubricate at least one of the at least one bearing and the at least one seal.

17. The roll line unit according to claim 14, wherein the support housing includes at least one support post and the at least one lubricant reservoir is located inside the at least one support post.

18. The roll line unit according to claim 14, wherein the lubricant in the at least one cavity is arranged to apply a pressure to at least one seal inside the support housing or to an outer seal configured to seal an inside of the support housing from an exterior environment.

19. The roll line unit according to claim 18, wherein the at least one seal inside the support housing is at least one of a bearing seal, a radial shaft seal, a mechanical seal, an axial clamp seal, an O-ring, a washer, a wear sleeve and a V-ring seal.

20. The roll line unit according to claim 14, further comprising at least one sensor configured to determine at least one of an amount of lubricant, a quality of lubricant, a temperature of lubricant and a contamination level of lubricant in one or more parts of the lubrication system.

* * * * *